United States Patent [19]

Pass

[11] Patent Number: 4,790,034

[45] Date of Patent: Dec. 13, 1988

[54] CAP HAVING A STIFFENER

[76] Inventor: Harold Pass, 7402 Boxwood Ct., Louisville, Ky. 40222

[21] Appl. No.: 82,323

[22] Filed: Aug. 6, 1987

[51] Int. Cl.[4] ..... A42B 1/02

[52] U.S. Cl. ..... 2/195; 2/255

[58] Field of Search ..... 2/195, 255, 256, 197, 2/180

[56] References Cited

U.S. PATENT DOCUMENTS

| | | | |
|---|---|---|---|
| 3,133,289 | 5/1964 | Lipschultz | 2/195 |
| 3,164,842 | 1/1965 | Weinstein | 2/195 |
| 4,686,713 | 8/1987 | Coleman et al. | 2/195 X |
| 4,691,389 | 9/1987 | Meyer | 2/195 |

*Primary Examiner*—Peter Nerbun

*Attorney, Agent, or Firm*—Jon C. Winger

[57] ABSTRACT

A cap having a crown formed of a plurality of crown segments in side-by-side relationship and having a visor attached to the crown brim and extending outwardly therefrom. The visor is laterally centered on and attached to the front of the crown brim. A stiffener is located to the interior of the crown to overlay the front portion of the crown to be supported against collapse and is biased toward the underlaying crown portion.

13 Claims, 2 Drawing Sheets

CAP HAVING A STIFFENER

BACKGROUND OF THE INVENTION

This invention relates to head wear and, more particularly, caps having stiffening elements in their crown.

Caps of the type including a visor extending from the cap crown are very popular. They are not only worn while participating in a sport, such as baseball or golf, but often are worn just as casual wear. Caps of this type are also frequently used to promote businesses and products by placing a logo or emblem on front side of the cap crown above the visor.

Preferably, cap crowns are made of a fabric material that is soft, pliable and light weight and, therefore, comfortable to wear. However, the crown is not self supporting and, therefore, the crown tends to collapse. The result is that not only does the cap look sloppy, but any logo, emblem or insignia on the front of the crown is less visible.

It has been known previously to add stiffening elements to caps to prevent the collapse of the crown.

U.S. Pat. No. 2,701,366, issued on Feb. 8, 1955 to R. R. Oberrender, shows one approach of adding stiffener means around the entire crown of the cap to use strips of stiff material extending upwardly of the crown in circumferentially spaced relationship around the crown and anchored to the cap lining by stitching them directly to the cap lining. Caps employing this construction present an overall stiff or upright crown, which is quite formal in appearance.

U.S. Pat. No. 3,133,289 issued on May 19, 1964 to Frank K. Lipschultz shows another approach for stiffening a cap crown using a sheet of fabric material which is somewhat flexible, but sufficiently rigid to underlie and support the front portion of the cap crown on the inside of the crown. A sheet of fabric material is typically inserted into the head band of the cap crown, or inserted into a pocket formed between the front of the cap crown and a second piece of material stitched to and underlying the front of the cap crown on the inside of the crown.

It is also known to use a stiffener of soft, flexible plastic material which is sufficiently rigid to underlie and support the front portion of a cap crown located at the inside of the crown. The sheet of plastic material has a strip of fabric stitched thereto along the bottom edge. The stiffener sheet is attached to the cap by stitching the strip of fabric to the crown brim. A head band is circumferentially positioned around the cap brim and overlays the strip of material fabric material, and stitched to the crown brim.

SUMMARY OF THE INVENTION

It is an object of the present invention to provide a cap with a crown wherein the crown is supported from collapsing, particularly at the front of the crown above the cap visor.

It is another object of the present invention to provide a cap wherein the crown is supported from collapsing which requires fewer manufacturing steps.

It is a further object of the present invention to provide a novel cap stiffener for supporting a cap crown.

More particularly, the present invention provides a cap comprising a crown having a brim and including a visor laterally centered on and attached to the front of the crown brim to extend outwardly therefrom, and a sheet of stiff material located under the crown centered between the junctures of the peripheral edge of the visor and crown having a bottom margin which is folded back over the sheet, and the folded back margin edge being attached to the crown brim.

BRIEF DESCRIPTION OF THE DRAWINGS

The features and advantages of the present invention will become even more clear upon reference to the following description in conjunction with the accompanying drawings in which the numnerals refer to like parts throughout the several views and wherein.

DETAILED DESCRIPTION

Figure 1:
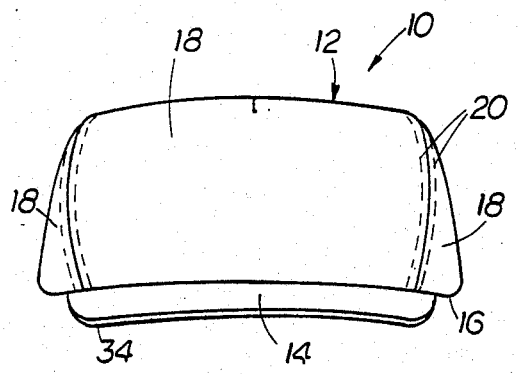
FIG. 1 is a front elevational view of a cap of the present invention.
Figure 2:
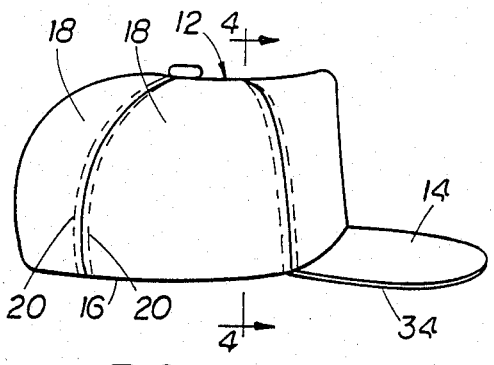
FIG. 2 is a right side elevational view of the cap of FIG. 1.
Figure 3:
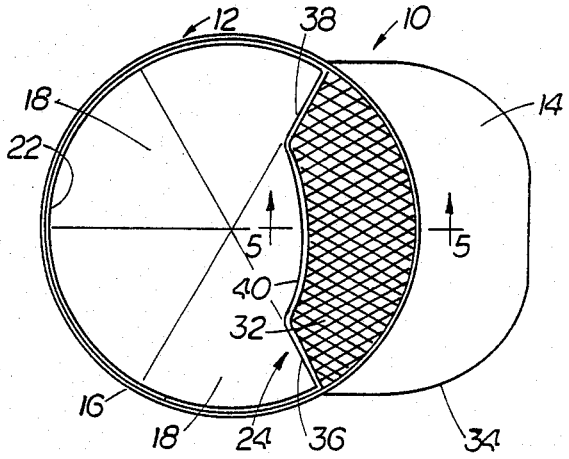
FIG. 3 is a bottom view of the cap of FIG. 1.

As best shown in FIGS. 1 through 3, there is illustrated a presently preferred embodiment of a cap 10 constructed in accordance with the present invention. The cap 10 comprises a crown 12 and a visor 14 attached to the crown brim 16 and located at the front of the crown 12 to extend outwardly therefrom.

With continued reference to FIGS. 1–3, the crown 12 is formed of a plurality of generally triangular crown segments 18 formed of a soft fabric such as wool, cotton and the like. The crown segments 18 are located in side-by-side relationship, with the side edges 22 of the crown segments.18 extending upwardly from the crown brim 16. Each crown segment 18 is fastened, by for example rows of stitching 20, to its contiguous crown segments 18. A circumferential head band 22 is attached to the interior surface of the crown 12 around the crown brim 16.

As further shown in FIGS. 1 and 3, the visor 14 is laterally centered on one of the crown segments 18. However, it is foreseeable that the segments 18 could be of a smaller size than those shown in the drawings, and, in that event, the visor 14 would be laterally centered on several front crown segments.

Figure 4:
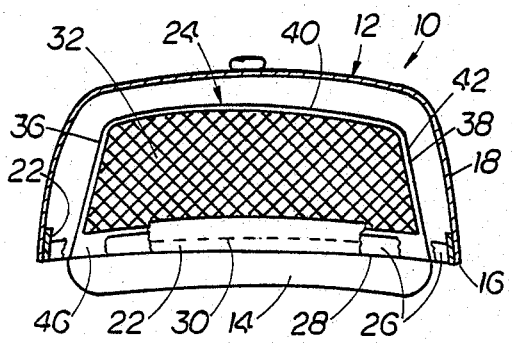
FIG. 4 is a cross-sectional view of the cap, taken along line 4—4 of FIG. 2.
Figure 5:
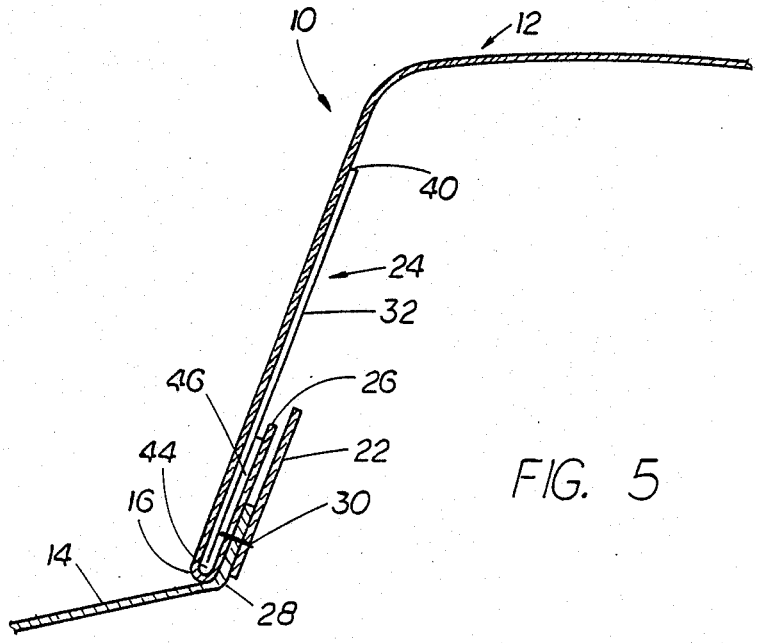
FIG. 5 is a cross-sectional view of the front portion of the cap as seen in the direction of arrows 5—5 in FIG. 3.

Now, with reference to drawing FIGS. 3 through 5, a cap crown stiffener, generally denoted as the numeral 24, is located to underlay the interior surface of the crown 12 at the front thereof centered between the junctures of the peripheral edge of the visor 14 and crown brim 16. As can be best seen in FIG. 5, the crown brim 16 is folded or turned back over the interior side of the cap crown to form an upturned circumferential cuff 26. As shown, the arcuate edge 28 of the visor 14 contiguous to the cap crown 12 and the circumferential head band 22 are positioned to overlay the exterior or exposed side of the upturned cuff 26 and are attached to the upturned cuff 26 by, for example, a line of stitches 30. As shown, the bottom margin edge of the cap stiffener 24 is disposed between the upturned cuff 26 and the interior surface of the crown 12.

Figure 7:
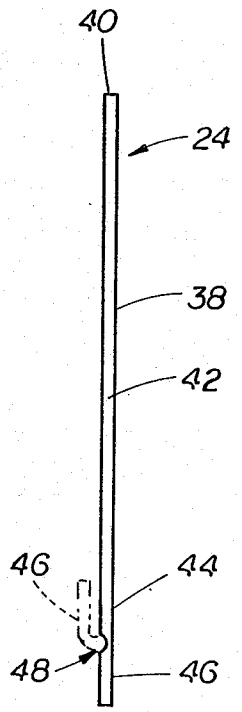
FIG. 7 is a side view of the cap crown stiffener of FIG. 6, but with the bottom margin folded preparatory to assembly to the cap crown.
Figure 6:
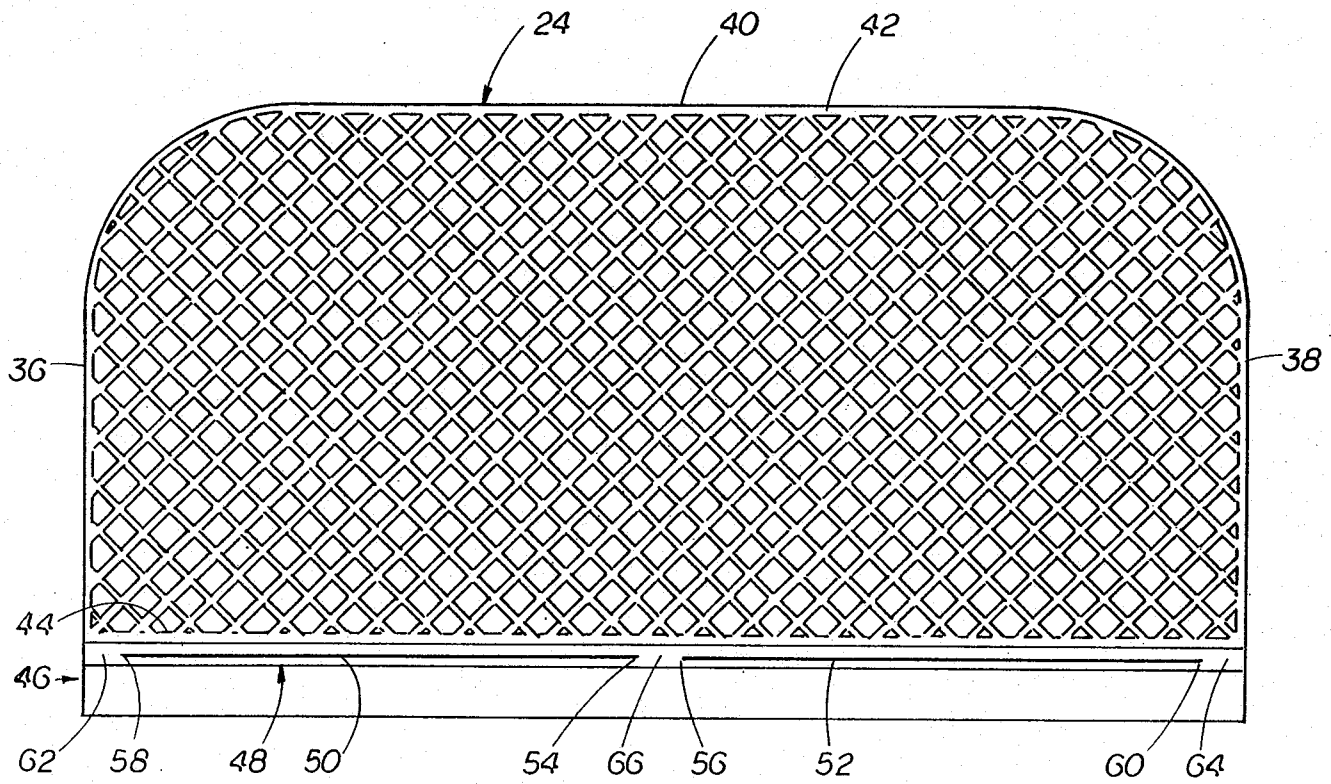
FIG. 6 is a plan view of the cap crown stiffener of the present invention.

With reference to FIGS. 6 and 7, and continued reference to FIG. 5, the cap crown stiffener 24 comprises a sheet 32 of open work or reticulated construction fabricated of a flexible material which can bend to conform to the arc of the cap brim 16, but which has sufficient stiffness to support the front of the crown from collapsing. The flexible material of the stiffener sheet 32 must also be moisture resistant so as not to be damaged by rain and perspiration. Various suitable materials are known, and include low density polyethylene. As can be best seen in FIGS. 6 and 7, the stiffener sheet 32 is generally rectangular in shape with a length dimension generally corresponding to the arcuate distance between the junctures of the peripheral edge 34 of the visor 14 and the crown brim 16 or the width of the front of the crown 12 to be supported against collapsing, and a width dimension corresponding to the height of the front of the crown 12 to be supported from collapsing. As illustrated, the two ends 36 and 38, and the top edge 40 of the stiffener sheet 32 have a thin border 42, and the bottom edge 44 has a margin 46 substantiallly wider than the thin border 42. The margin 46 includes a resilient hinge joint 48 extending parallel to the bottom edge 44 so that the margin 46 can be folded back over the stiffener sheet 32 along the bottom edge as can be best seen in FIG. 7. As can be best seen in FIG. 6, the hinge joint 48 includes two elongated slits 50 and 52 through the thickness of the margin 46 in longitudinal alignment with each other, and longitudinally spaced apart from each other such that the proximal mutually adjacent terminating ends 54 of slit 50 and 56 of slit 52 are spaced apart. In addition, the other or distal terminating ends 58 and 60 of the slits 50 and 52, respectivley, are spaced from the opposite ends of the margin 46, respectively. The distal ends 58 and 60 being spaced from the ends of the margin 46 define two hinge connections 62 and 64, and the proximal ends 54 and 56 define a third hinge connection 66. It is contemplated that the hinge joint 48 can be a "living hinge" such as a groove be formed in the margin 46 in place of the two slits 50 and 52, as an equivalent thereof depending upon the material of the stiffener 24 and thickness of the stiffener margin 46.

Now referring once again to FIG. 5, the bottom margin 46 of the stiffener 12 is folded back about the hinge joint 48 to overlay the stiffener sheet 32 of the stiffener 24, and the crown stiffener 24 is located to the interior of the crown 12 with the folded over bottom margin 46 in the fold of the circumferential upturned cuff 26, that is between the upturned cuff 26 and interior surface of the crown 12, with the stiffener sheet 24 extending upwardly in overlaying relationship to the interior surface of the front portion of the crown 12 to be supported. The pivot axis of the hinge joint 48 is thus generally parallel to the crown brim 16. The margin 26 is attached to the upturned cuff 26 by virtually any convenient means, such as the row of stitches 30. The hinge joint 48 is resilient so that the folded over margin 46 is biased to unfold about the hinge joint 48 toward the unfolded position shown in FIG. 6. Thus, the stiffener sheet 32 is biased toward and against the interior surface of the cap crown to more efficiently support the front portion of the crown 12.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed is:

1. A cap comprising:
(a) a crown; and
(b) a crown stiffener located to the interior side of the crown to overlay at least a front portion of the crown to be supported from collapsing and biased toward the underlaying crown portion, the stiffener is attached to the crown proximate the crown brim and the stiffener comprises a resilient hinge joint proximate the attachment of the stiffener to the crown brim having a pivot axis generally parallel to the crown brim about which the stiffener is biased toward the underlaying crown portion.

2. The cap of claim 1, further comprising:
a circumferential cuff at the interior of the crown extending upwardly from the crown brim; and,
the stiffener is attached to the circumferential cuff.

3. The cap of claim 2, wherein the stiffener is located in the fold of the cuff.

4. The cap of claim 1, wherein the hinge joint is located below the attachment of the stiffener to the crown brim.

5. The cap of claim 1, wherein the stiffener further comprises:
a stiffener sheet overlaying the portion of the crown to be supported from collapsing; and
a bottom margin interconnected to the stiffener sheet by the hinge joint, the bottom margin being attached to the crown proximate the crown brim.

6. The cap of claim 5, wherein the bottom margin is folded back over the stiffener sheet about the hinge joint.

7. The cap of claim 6, wherein the cap further comprises:
(a) a circumferential cuff at the interior of the crown brim extending upwardly from the crown brim; and,
(b) the bottom margin of the stiffener is attached to the cuff.

8. The cap of claim 7, wherein the bottom margin of the stiffener is disposed in the fold of the cuff.

9. The cap of claim 5, wherein the stiffener sheet is of open work construction.

10. A stiffener for a cap to be located to the interior side of the cap crown comprising:
a stiffener sheet for overlaying at least a portion of the crown to be supported from collapsing;
a bottom margin of the stiffener sheet extending above the bottom edge of the stiffener sheet; and,
a resilient hinge joint interconnecting the margin and bottom edge of the stiffener sheet.

11. The stiffener of claim 10, wherein the stiffener sheet, resilient hinge joint, and bottom margin are integral.

12. The stiffener of claim 11, wherein the hinge joint comprises at least one slit formed through the bottom margin extending parallel to the bottom edge of the stiffener sheet less than the entire length of the margin.

13. The stiffener of claim 12, wherein the at least one slit comprises at least two slits in longitudinal alignment with each other, longitudinally spaced apart from each other, and spaced from the ends of the margin.

* * * * *